United States Patent [19]

Fields et al.

[11] 4,071,919

[45] Feb. 7, 1978

[54] WASTE CHUTE CLEANING APPARATUS

[76] Inventors: Cary Lynn Fields, New York, N.Y. 10021; John Anthony Fernandez, 21 Joludow Drive, Massapequa, N.Y. 11762; Salvatore Cortese, 7809-97th Ave., Queens, N.Y. 11416

[21] Appl. No.: 770,325

[22] Filed: Feb. 22, 1977

[51] Int. Cl.[2] ..... A46B 13/04

[52] U.S. Cl. ..... 15/21 R; 15/104.2; 15/163; 134/167 C

[58] Field of Search ..... 15/3, 21 R, 104.05, 15/104.09, 104.16, 104.2, 104.3 R, 162, 163, 242, 243, 249; 134/22 C

[56] References Cited

U.S. PATENT DOCUMENTS

| | | | |
|---|---|---|---|
| 2,641,791 | 6/1953 | Wells | 15/163 |
| 3,946,459 | 3/1976 | Armstrong | 15/104.2 |

FOREIGN PATENT DOCUMENTS

| | | | |
|---|---|---|---|
| 1,245,570 | 7/1967 | Germany | 15/163 |

*Primary Examiner*—Edward L. Roberts
*Attorney, Agent, or Firm*—William Anthony Drucker

[57] ABSTRACT

A cleaning apparatus for waste shafts has a cleaning head with peripheral brushes fixed to the head, a vibrator mounted on the head vibrating the head and thereby the brushes, a lower spray head below the brushes for applying a cleaning solution, and an upper spray head above the brushes for applying an insecticide. The cleaning head is lowered down a waste shaft by a hose containing two fluid paths, each connected to a spray head, and containing electric wires connected to the vibrator. A cart containing water, soap or detergent, insecticide, and scent tanks has metering pumps delivering fluids from the tanks through a rotary fitting to the hose which is mounted on a motor driven reel to lower the head. The hose passes over a roller clamped within an opening in the shaft. The cart may contain batteries for its operation and electronic controls and recording devices.

9 Claims, 7 Drawing Figures

WASTE CHUTE CLEANING APPARATUS

BACKGROUND OF THE INVENTION

Waste compactors have replaced incinerators in high-rise buildings in response to new laws intended to control air pollution. The garbage chutes down which domestic wastes are dropped to compactors become lined with filth which decays to give off a horrible odor. This soil and the walls of the chutes breed and harbor insects that are impossible to reach with conventional cleaning and exterminating techniques. This invention provides a cleaning and exterminating apparatus for waste shafts.

SUMMARY OF THE INVENTION

A waste shaft cleaning apparatus has a cart which contains tanks for water, a detergent, pine scent, and an insecticide. Metering pumps deliver fluids from these tanks through a rotatable fittng to a reel mounted hose containing two fluid paths and electric wires. The cart contains its own battery power source and a reel drive to extend the hose.

A hose roller clamp mounted in a shaft opening directs hose from the cart to a cleaning head hanging therefrom in the shaft. The cleaning head is spring mounted and has a vibrator fixed to it driven by current from the electric wires in the hose. Peripheral brushes scrub the shaft walls as the head vibrates. A lower spray nozzle connected to one fluid path of the hose wets the shaft with detergent and water to loosen coated filth prior to its being scrubbed. An upper spray nozzle above the brushes connected to the other fluid path of the hose sprays the shaft with an insecticide after it has been cleaned. Either nozzle may additionally spray the shaft with a pine scent. Thus as the head is lowered down a waste chute, it cleans it and exterminates insects therein.

Electronic sensors in the cart control the fluids pumped to the cleaning head according to the speed at which it is lowered. An electronic printout records the number of vertical feet of shaft cleaned and prints a bill for the service.

DESCRIPTION OF THE PREFERRED EMBODIMENT

Figures 1, 2, 3:
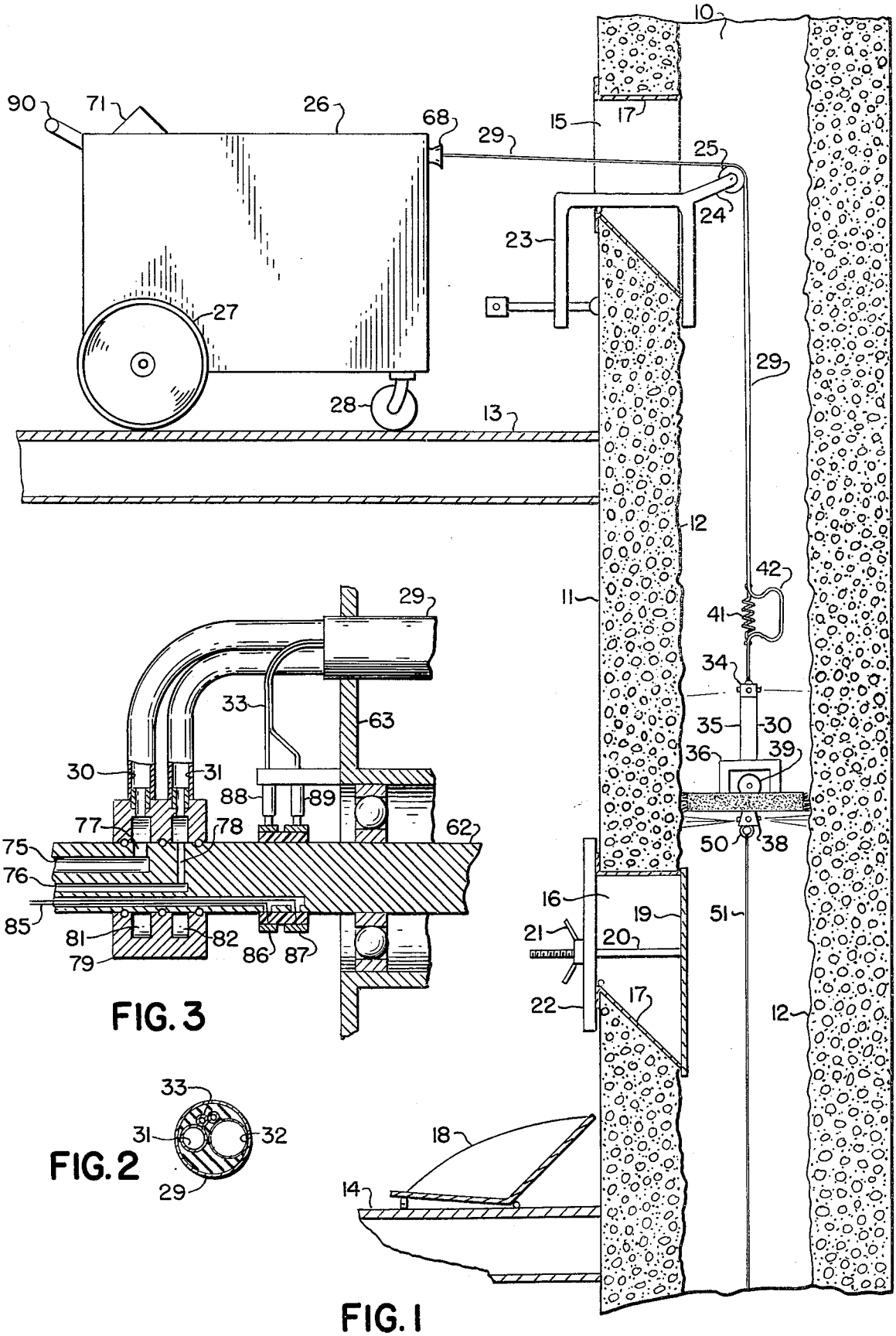
FIG. 1 is a vertical section through a building wall containing a garbage disposal shaft and having broken away portions of floors connected thereto, the upper floor having a cart thereon from which a cleaning head is lowered down the shaft over a pulley clamped in a shaft opening, the lower floor having a shaft opening in which a closure is fixed, the hopper removed from the opening being placed on the floor.
FIG. 2 is a transverse section through a hose which is connected to and lowers the cleaning head.
FIG. 3 is a longitudinal section through a rotary fitting connecting a fluid supply and electric wires to a reel.

As shown in FIG. 1, a building has a waste chute or shaft 10 leading to a compactor (not shown). Chute 10 is usually formed in a masonry wall 11 with rough inner surfaces 12. An upper floor 13 and a floor 14 therebelow are shown. Shaft openings 15 and 16 each have a suitable metal liner 17 fixed in place which removably mounts a garbage hopper 18 or other closure. As shown, the hoppers 18 are removed with the hopper 18 from opening 16 resting on floor 14.

To prepare a waste chute 10 for cleaning, the hoppers or doors 18 are removed from the openings 15 and 16 and on all lower openings 16 a cover 19 of plywood or the like is held as a spray proof closure by a threaded extension rod 20 and a hand nut 21 which is turned down over an exterior bracket 22. Any suitable closure 19 may be used and, in some installations, the hoppers or doors 18 may be left in place if they are spray proof and easily treated with insecticide. A clamp 23 is fixed about the sill of the uppermost opening 15. Clamp 23 has an inward projecting arm 24 which mounts a hose roller 25. A self-contained cart 26 on wheels 27 and 28 extends a hose 29 over roller 25 to lower a cleaning head 30 down chute 10.

Figure 4:
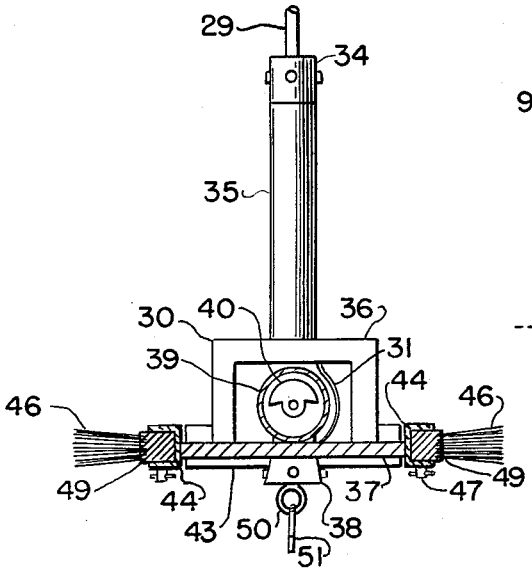
FIG. 4 is a vertical section through a cleaning head.
Figure 5:
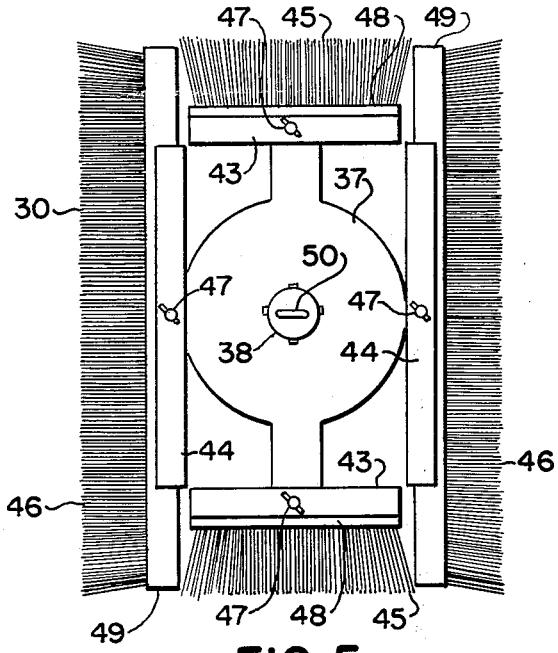
FIG. 5 is a bottom view of the cleaning head of FIG. 4.

Referring additionally to FIGS. 2, 4 and 5, cleaning head 30 is fixed to hose 29 by any well known releasable fitting. Hose 29 contains two fluid paths 31 and 32 and insulated wires 33. Fluid path 31 is connected to an upper spray head 34 which sprays at least an insecticide in the cleaned chute 10 as head 30 is lowered. Below head 34 a support member 35 is fixed to a bracket 36 which is joined to base plate 37. Below base plate 37 is a lower spray head 38 connected to fluid path 32 to spray at least a water and cleaning fluid solution onto chute 10.

Mounted on base plate 37 is an electric motor 39 to which the wires 33 are connected. Motor 39 carries eccentric weights 40 to oscillate or vibrate head 30. This oscillation may be increased by a spring 41 fixed across a loop 42 of hose 29. Channel flanges 43 and 44 are fixed on the ends and sides of base plate 37 to hold the pairs of brushes 45 and 46 by means of clamp screws 47 which engage and hold the brush backs 48 and 49. A ring 50 under lower spray head 38 has a line 51 fixed thereto to pull head 30 downward if it jams in chute 10. Thus it may be seen that the lowering of head 30 down a chute 10 applies a water and soap or detergent spray to it, scrubs it with oscillating brushes 45 and 46, and applies an insecticide to the cleaned walls. A pine or other scent may be applied to the chute 10 with the wash water or the insecticide.

Figure 6:
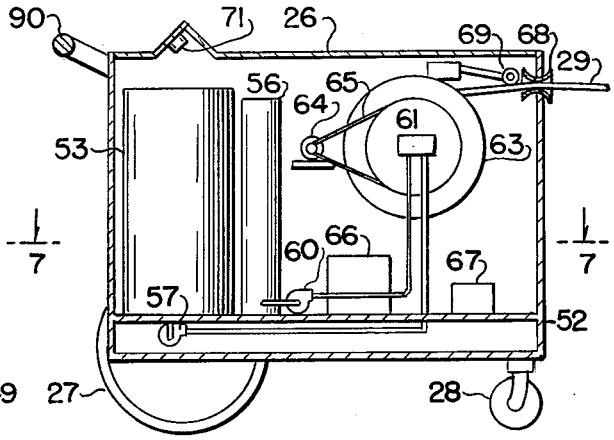
FIG. 6 is a vertical, longitudinal section through the cart.
Figure 7:
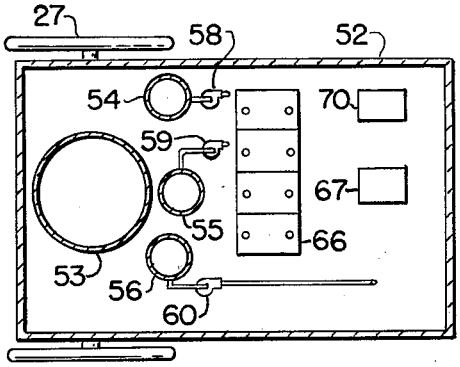
FIG. 7 is a horizontal section taken on line 7—7 of FIG. 6.

Referring now to FIGS. 6 and 7, cart 26 has a body 52 containing four tanks 53, 54, 55, and 56. The largest tank 53 is filled with water and the three smaller tanks 54, 55, and 56 with detergent, pine scent, and insecticide, respectively. Each tank 53–56 is connected to a metering pump 57–60, respectively. Pumps 57–60 mix and deliver fluids to a fitting 61 mounted on a fixed shaft 62 shown in FIG. 3. Shaft 62 mounts a reel 63 on which is wound one end of hose 29. A motor 64 with a suitable drive 65 lowers cleaning head 30 by turning reel 63. After each cleaning operation, motor 64 rewinds hose 29 on reel 63.

Power for motor 64 and pumps 57–60 may be supplied by batteries 66 which are kept energized by a plug-in charger 67. Hose 29 passes from cart 26 through a suitable fitting 68. A sensing device with a roller or the like 69 is connected to electronic circuitry in box 70. This circuitry monitors the unreeling of hose 29 to control the pumps 57–60 as head 30 is lowered. The progress of head 30 is indicated by instruments 71 and conventional printout apparatus (not shown) prints and expells a card showing the number of feet of chute 10 cleaned and the total bill for the amount of cleaning done.

As shown in FIG. 3, fixed shaft 62 contains longitudinal passages 75 and 76 with longitudinally offset radial openings 77 and 78. A rotatably mounted fitting 79 has annular channels 81 and 82 disposed over openings 77 and 78. Fluid channels 30 and 31 are connected to the annular channels 81 and 82 of fitting 79. Fitting 79 revolves with reel 63 and allows pumped fluid from tanks 53–56 to reach the spray heads 34 and 38. Electric wires 85 from batteries 66 are connected to the insulated slip rings 86 and 87 which are contacted by the reel mounted brushes 88 and 89 to energize the wires 33 to drive motor 39.

A handle 90 is provided to move cart 26 and the wheels 27 and 28 are provided with a brake (not shown). Two men with almost no training can easily operate the apparatus of this invention to clean 10 or more floors at a time. One man stays with the cart 26 to lower head 30 while the other goes to lower floors 14 to remove the hoppers 18 and seal the openings 16 if required. When 10 or more floors are cleaned, the man on the lowermost cleaned floor removes the cleaning head 30 when it reaches him and the hose 29 is reeled back into cart 26. The hoppers 18 are replaced and the cart 26 is moved to the lowermost cleaned floor to again lower head 30 to further clean chute 10 adjacent to additional lower floors.

While this invention has been shown and described in the best form known, it will nevertheless be understood that this is purely exemplary and that modifications may be made without departing from the spirit of the invention.

What is claimed is:

1. An apparatus for cleaning waste chutes comprising, in combination, at least a first tank for a cleaning solution, a second tank for an insecticide, a hose containing first and second fluid paths and electric wires, means introducing cleaning solution from said first tank into said first fluid path of said hose, means introducing insecticide from said second tank into said second fluid path of said hose, a current source connected to said wires of said hose, a cleaning head attached to said hose, said cleaning head having an upper spray head connected to said second fluid path of said hose, peripheral brushes below said upper spray head, a vibrator fixed to said spray head and connected to said wires of said hose, and a lower spray head below said brushes connected to said first fluid path of said hose, and means lowering said cleaning head down a waste chute, said lower spray head spraying the waste chute with a cleaning solution as said cleaning head is lowered, said brushes being oscillated by said vibrator cleaning the sprayed chute, and said upper spray head spraying the cleaned chute with insecticide.

2. The combination according to claim 1 wherein said first tank is a water tank and a cleaning solution tank, said means introducing a cleaning solution into said first fluid path of said hose are first and second metering pumps connected to said water and said cleaning solution tanks, and said means introducing an insecticide into said second fluid path of said hose is a third metering pump.

3. The combination according to claim 2 with the addition of a scent tank, and a fourth metering pump introducing fluid from said scent tank into one of said fluid paths of said hose.

4. The combination according to claim 3 with the addition of a cart, said cart containing said tanks, said metering pumps, and said means lowering said cleaning head.

5. The combination according to claim 4 wherein said current source connected to said wires of said hose is batteries, said batteries being in said cart.

6. The combination according to claim 5 wherein said means lowering said cleaning head is a reel on which said hose is wound, a rotary fitting connecting said metering pumps to said fluid paths of said hose, slip rings, brushes contacting said slip rings connected between said batteries and said wires in said hose, a motor, and a drive enabling said motor to turn said reel lowering said cleaning head.

7. The combination according to claim 6 with the addition of a clamp mounted hose roller to be fixed in a waste chute, said hose extending from said cart over said roller to lower said cleaning head.

8. The combination according to claim 7 with the addition of spring means supporting said cleaning head.

9. The combination according to claim 8 wherein said spring means is a spring, said hose containing a loop within which said spring is attached.

* * * * *